US006824463B1

(12) United States Patent
Yamaguchi et al.

(10) Patent No.: US 6,824,463 B1
(45) Date of Patent: Nov. 30, 2004

(54) NUMBER DRAWING APPARATUS AND GAME MACHINE THEREWITH

(75) Inventors: Takashi Yamaguchi, Kanagawa (JP); Takashi Kumabe, Kanagawa (JP); Tetsuo Ishimaru, Kanagawa (JP); Nobuhiro Goto, Kanagawa (JP); Takeshi Oginuma, Kanagawa (JP)

(73) Assignee: Konami Corporation, Tokyo (JP)

( * ) Notice: Subject to any disclaimer, the term of this patent is extended or adjusted under 35 U.S.C. 154(b) by 0 days.

(21) Appl. No.: 09/691,435

(22) Filed: Oct. 18, 2000

(30) Foreign Application Priority Data

Oct. 20, 1999 (JP) ..... 11-298281

(51) Int. Cl.[7] ..... A63F 5/00

(52) U.S. Cl. ..... 463/17; 273/142 R

(58) Field of Search ..... 273/138.1, 138.2, 273/138.3, 138.4, 139, 142 R, 143 R, 143 A, 142 D, 142 C, 142 F, 394, 398, 125 R, 125 A; 463/16, 17

(56) References Cited

U.S. PATENT DOCUMENTS 1,491,961 A * 4/1924 Miller ..... 273/142 E
2,001,500 A * 5/1935 Rothen ..... 273/138.1
2,364,141 A * 12/1944 Harris ..... 124/16
4,712,796 A * 12/1987 Reiss ..... 273/148 R
4,735,416 A * 4/1988 McNally ..... 463/22
5,879,235 A * 3/1999 Kaneko et al. ..... 273/142 R
6,135,884 A * 10/2000 Hedrick et al. ..... 463/20

FOREIGN PATENT DOCUMENTS

| | | |
|---|---|---|
| GB | 211283 | 12/1922 |
| GB | 995431 | 10/1961 |
| GB | 2 344 540 | 8/1998 |
| JP | 362528 | 6/1999 |
| WO | WO 95/05877 | 3/1995 |
| WO | WO 97/18870 | 5/1997 |

OTHER PUBLICATIONS

Marshall Fey, Slot Machines: A Pictoral History of the First 100 Years, 5th Ed., Liberty Bell Books (1997), pp. 20, 60, 72, 96 & 229.*

* cited by examiner

*Primary Examiner*—Mark Sager
*Assistant Examiner*—Steven Ashburn
(74) *Attorney, Agent, or Firm*—Bachman & LaPointe, P.C.

(57) ABSTRACT

A number drawing apparatus includes a rotating unit and collecting holes. Each ball, supplied from a supply unit provided in the central portion of the rotating unit when it rotates, randomly rolls on a surface of the rotating unit. A centrifugal force by the rotation causes each ball to move outwardly from the rotating unit, and each ball is caught in one of catching holes. Unique identifying symbols are assigned to the catching holes. This enables the draw.

44 Claims, 7 Drawing Sheets

NUMBER DRAWING APPARATUS AND GAME MACHINE THEREWITH

BACKGROUND OF THE INVENTION

1. Field of the Invention

The present invention relates to a number drawing apparatus that provides a fair draw of numbers for entertainment purposes using rolling bodies such as spheres (balls), and relates to a game machine provided with the number drawing apparatus.

2. Description of the Related Art

In games such as bingo, a player is often blindfolded and allowed to pick some balls from among a plurality of balls so as to be excited with anticipation.

There are bingo game machines that automatically perform the selection operation. For example, Japanese Unexamined Patent Application Publication No. 6-71010 discloses a bingo game machine (herein, termed the first well-known art) including a spherical rotating basket, which rotates to mix a plurality of balls in the basket, and a ball catcher provided in the rotating basket; each ball bears a symbol, and when a ball from among the mixed up balls falls into the ball catcher, the symbol thereon is read.

There is also a bingo game machine (herein, termed the second well-known art) including a rotating dish that slowly rotates on a center axis at the concave central portion and a plurality of marked ball catchers provided on the rotating dish, in which a plurality of balls, rolled onto the rotating disk by some technique, fall into some of the ball catchers, and symbols corresponding to the ball catchers are used for bingo.

In the first well-known art, the mechanism for rotating the basket for mixing the balls is complex, which increases the total cost of the game machine. Since the game machine allows the player to select one ball from among the mixed balls and leads the selected ball to a detecting unit to detect its unique identification, an identifying symbol must be provided on each of the balls, and this increases the cost of the balls. In addition, all the mixed balls must be caught by the ball catchers, so that the total time required for one game may be prolonged.

In the second well-known art, the added cost of the balls, which is a problem in the first well-known art, is eliminated because the selected symbol is instead specified by a corresponding ball catcher on the rotating dish. Nevertheless, the cost of the rotating dish itself is higher due to the division of the dish in order to satisfy the need to provide the rotating dish with ball-catching holes including sensors. When the balls move outwardly or fall into the center, there may be a case where the time required for one game is prolonged because the user must put balls back into the game machine.

In both the first well-known art and the second well-known art, the fairness of the bingo is emphasized, and it is not intended that the movement of the balls themselves be enjoyed by the players.

SUMMARY OF THE INVENTION

Accordingly, it is an object of the present invention to provide a number drawing apparatus in which time management is improved and which is very entertaining, and to provide a game machine provided with the number drawing apparatus.

It is another object of the present invention to provide a game machine including the above-described number drawing apparatus, which provides a player with a game prize in accordance with the result of the draw by the above number drawing apparatus.

To these ends, according to an aspect of the present invention, the above objects are achieved through provision of a number drawing apparatus including a rotating unit having a surface which rolls rolling bodies supplied thereon, and a driving unit for rotating the rotating unit in a fixed plane so that the supplied rolling bodies move outwardly. Information specified by the outward movement of each of the supplied rolling bodies is used as the result of the draw.

Preferably, unique information specified by the moving rolling bodies when the bodies have stopped is used as the result of the draw.

A plurality of regions to which unique symbols are assigned may be provided along the periphery of the rotating unit, and the result of the draw may be determined by the symbols assigned to the regions in which the rolling bodies stops.

According to another aspect of the present invention, the above objects are achieved through provision of a number drawing apparatus including a rotating unit having a surface which rolls rolling bodies supplied to the surface, a rolling-body supply unit for supplying the rolling bodies from the central portion of the rotating unit to the surface, a driving unit for rotating the rotating unit in a fixed plane so that each of the supplied rolling bodies randomly travels outwardly from a supplied position in a direction toward the periphery of the rotating unit, and a plurality of catching units provided along the periphery of the rotating unit, the catching units each having a unique symbol assigned thereto. The result of the draw is specified by the symbol assigned to the catching unit in which the moving rotating body having flown out is caught.

Preferably, the plurality of catching units each include a detecting means for outputting a predetermined signal when the rolling body is caught, and the output signal specifies the symbol assigned to the catching unit in which the rolling body is caught.

When the catching units catch the rolling bodies, the catching units may hold the rolling bodies so that the rolling bodies partly protrude, and may allow the rolling bodies to fall with predetermined timing.

Until N different symbols are determined in sets of N rolling bodies where N represents a natural number not less than 2, the catching units may hold the N rolling bodies, and may allow all the N rolling bodies to simultaneously fall with predetermined timing.

The rolling-body-supply means may include a supply hole for supplying the rolling bodies, and a guidance mechanism for accelerating the rolling bodies and for guiding the accelerated rolling bodies to the surface.

Preferably, the distance between the supply hole and the surface is equal in all directions.

The number drawing apparatus may further include a return wall for returning each of the rolling bodies which has not been caught by any one of the catching units.

Preferably, the return wall accelerates the rolling body and returns the accelerated rolling body.

The rolling bodies may be spheres.

According to another aspect of the present invention, the above objects are achieved through the provision of a number drawing apparatus including a rotating unit having a surface which rolls rolling bodies in which each attitude of the rolling bodies or each position at which the rolling bodies stop specifics a unique symbol, a rolling-body supply unit for supplying the rolling bodies from the central portion of the rotating unit to the surface, and a driving unit for rotating the rotating unit so that each of the supplied rolling bodies randomly moves outwardly from a supplied position in a direction toward the periphery of the rotating unit. Symbols specified by the rolling bodies when the rolling bodies have stopped are used as the results of the draw.

Preferably, the game machine is a bingo game machine in which the result of the draw provides different effects to a plurality of game players.

DESCRIPTION OF THE PREFERRED EMBODIMENTS

An embodiment in which the present invention is applied to a bingo game machine is described below with reference to the accompanying drawings.

Figure 1:
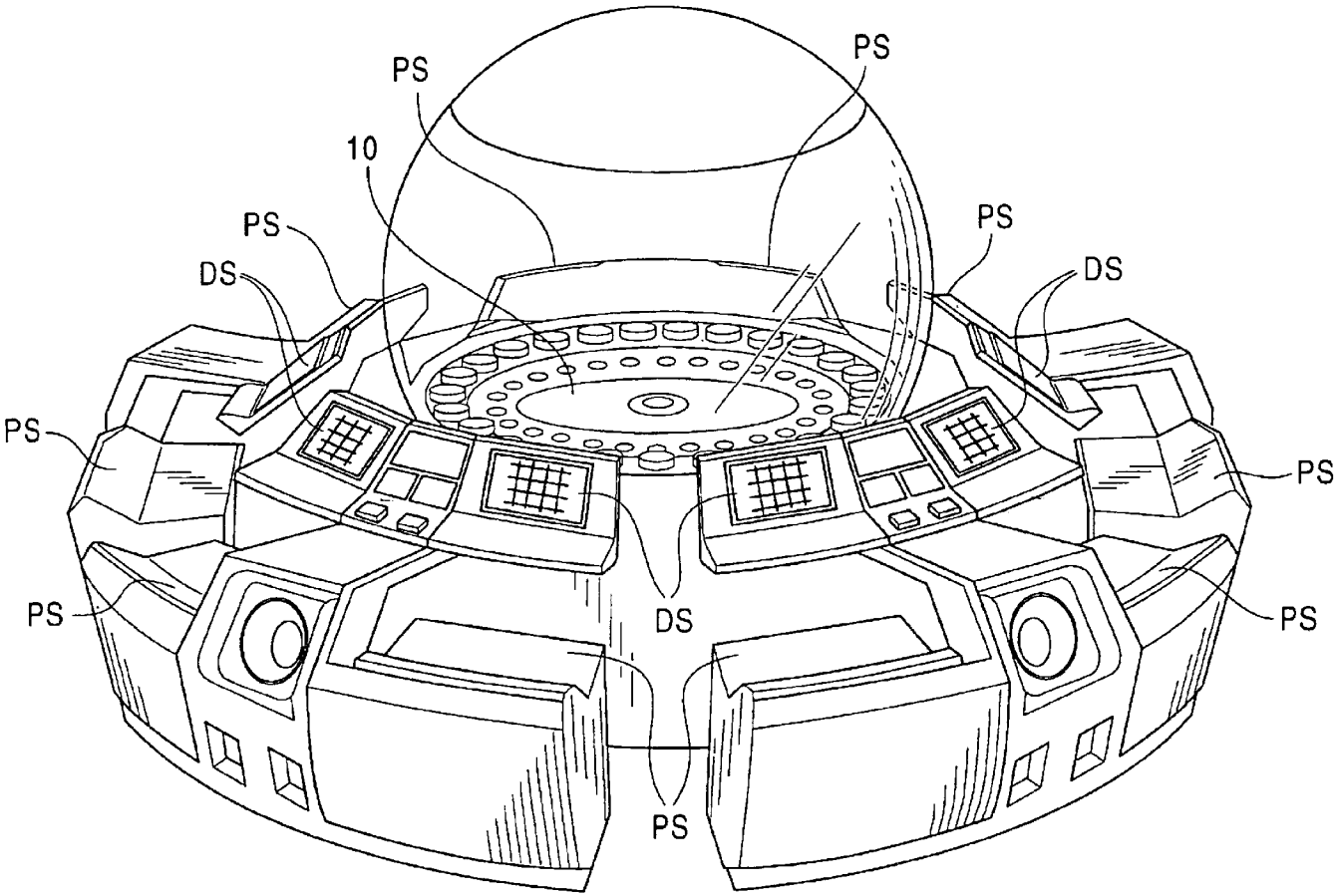
FIG. 1 is a perspective external view of a bingo game machine according to an embodiment in which the present invention is applied to a game machine.

FIG. 1 is a perspective external view of a bingo game machine. The bingo game machine uses seven resin balls as rolling bodies for the draw of numbers, and provides a plurality of (a maximum of ten) players with a bingo game environment using 25 different symbols. The bingo game machine includes a number drawing apparatus 10 disposed in a playing area so as to be visible by each player, and ten player seats PS. For each player seat PS, a display screen DS is provided to show each player the results of the draw by the number drawing apparatus 10 and to show a record of the draws since the start of the game. Also, a mechanism for providing a game winner (bingo player) with a game prize (token, etc.) is provided. The information displayed on the display screen DS is unique for each player. The number of balls for the draw is not limited to seven, and any number of balls may be used.

Figure 2:
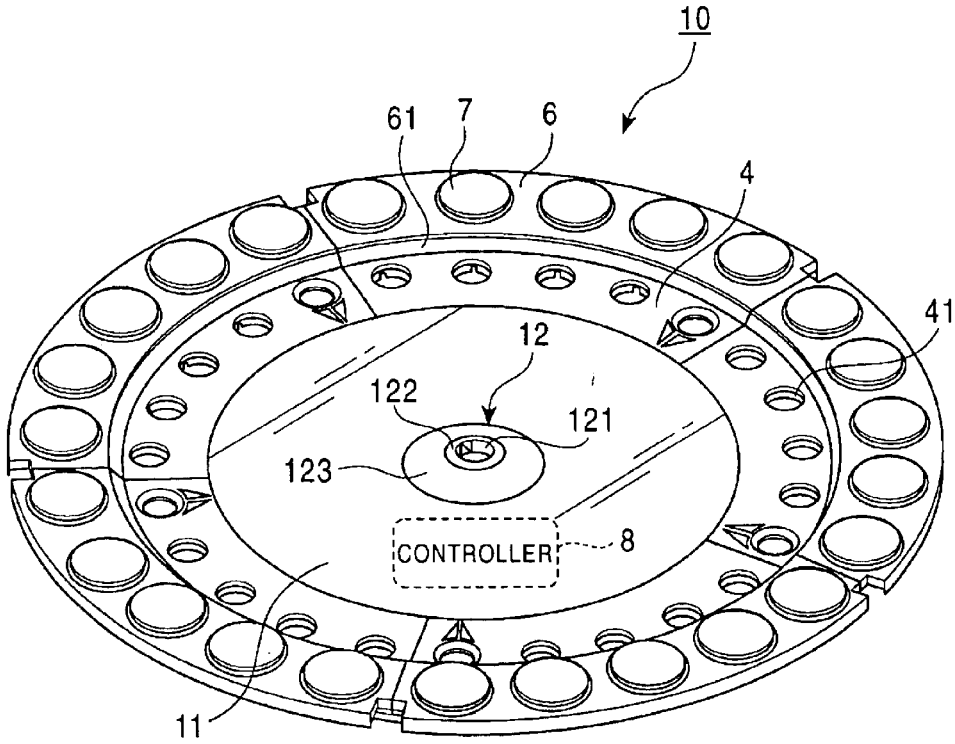
FIG. 2 is a perspective external view of a main structure of a number drawing apparatus in an embodiment of the present invention.
Figure 3:
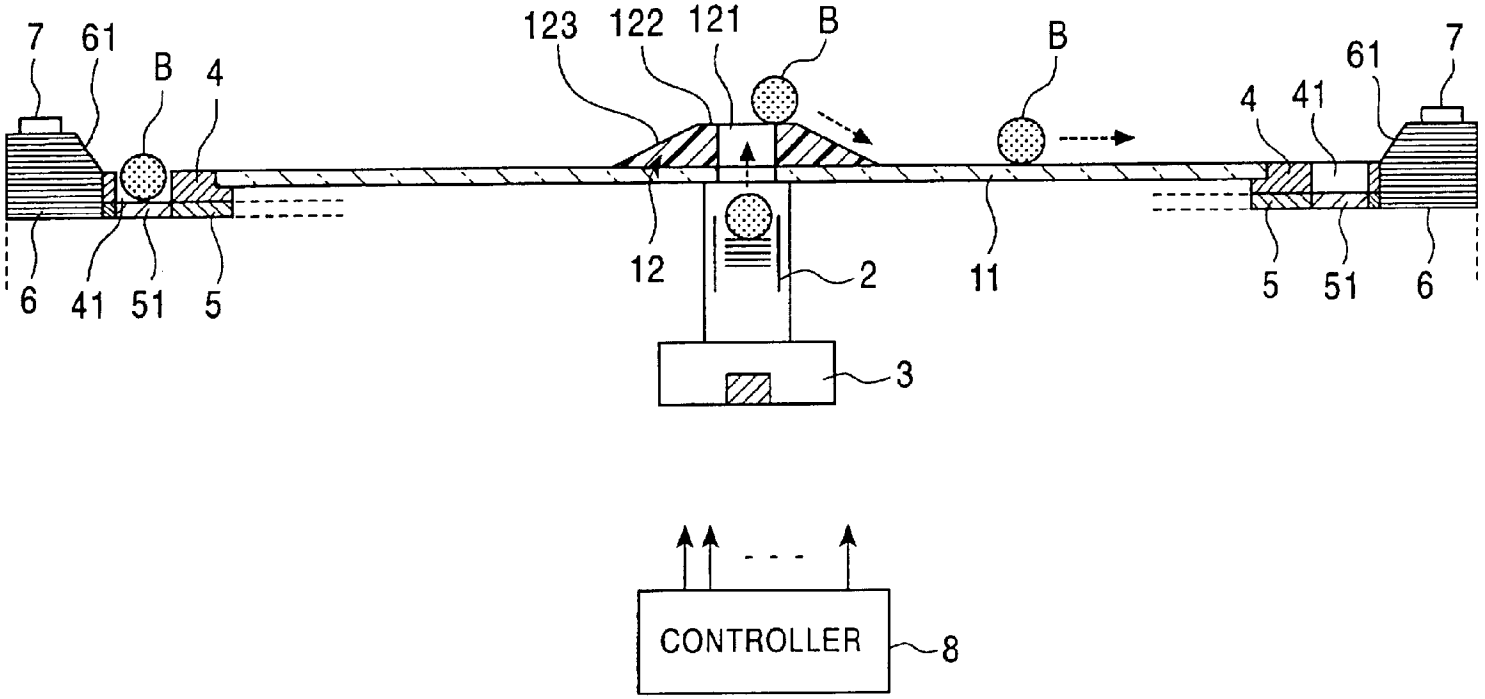
FIG. 3 is a cross sectional view of a main structure of the number drawing apparatus shown in FIG. 2.

FIG. 2 is a perspective external view showing the main structure of the number drawing apparatus 10 in the bingo game machine, and a section of the main structure is shown in FIG. 3.

The number drawing apparatus 10 includes a rotating unit 11 having a surface for rolling balls B, a rotator mechanism 3 for rotating the rotating unit 11, a supply unit 12 for supplying the balls B one by one from the central portion of the rotating unit 11 during rotation to the surface of the rotating unit 11, a ball-supply mechanism 2 for supplying the supply unit 12 with the balls B in sets of seven balls, a ball-catching mechanism 4 provided along the periphery of the rotating unit 11, a ball-collecting mechanism 5 provided on the back of the ball-catching mechanism 4 a display ring 6 provided along the periphery of the ball-catching mechanism 4, and a controller 8 for controlling overall operations of the entire number drawing apparatus.

The display ring 6 is formed to be higher than the ball-collecting mechanism 5, and its inclined sidewall 61 functions as a return wall for returning the ball B to the rotating unit 11. The inclined sidewall 61 has an angle of inclination that can accelerate the ball B when it is being returned.

Although the inclined sidewall 61 illustrated in FIG. 3 is straight, it may be concavely curved.

On the top surface of the display ring 6, 25 indicator units 7 are provided corresponding to 25 different symbols. By emitting light directed at a player who has only to one more number to reach bingo, each indicator unit 7 informs each player of this fact and symbols indicating "BINGO!". Specifically, each indicator unit 7 includes, in a housing, a plurality of light emitters that can emit beams in different directions, and a control mechanism that allows all or some of the light emitters to emit beams based on instructions from the controller 8.

Symbols corresponding to each indicator unit 7 are written so as to be easily seen by each player.

The rotating unit 11 is a light-transmissive disk member, for example, a glass plate or an acrylic plate, and rotates in a fixed plane perpendicular to its vertical axis. The surface of the rotating unit 11 is formed to be plane or is dish-shaped. Preferably, a transparent member is used to form the rotating unit 11, and a photograph or a decorative backing is provided on the back of the rotating unit 11. By doing so, it appears as if the rotating unit 11 does not exist and each ball B is moving autonomously above the backing. This makes the draw entertaining.

The supply unit 12 includes a guide (guidance mechanism) having a supply hole 121 for supplying the ball B carried by the ball-supply mechanism 2 to the surface of the rotating unit 11. This guide is frustum-shaped, in which an outlet surface 122 of the supply hole 121 is an upper base, and an area tangent to the rotating unit 11 is a lower base. The guide accelerates each ball B carried to the outlet surface 122 by an inclined surface 123, and supplies the accelerated ball B to the rotating unit 11. The distance from the supply hole 121 to the surface is set so as to be equal in all directions. This allows the ball B to roll in a random direction under uniform conditions. Although the ball B is carried to the supply hole 12 by, for example, an electric elevating mechanism by the ball-supply mechanism 2, it may be carried by air pressure.

The ball-catching mechanism 4 is a toroidal fixed plate on which 25 catching holes 41 for catching balls B are formed. The ball-collecting mechanism 5 is opposed to the ball-catching mechanism 4 with a predetermined distance therebetween. The ball-collecting mechanism 5 is a toroidal plate having a shape substantially identical to that of the ball-catching mechanism 4, on which 25 collecting holes 51 are formed corresponding to the 25 catching holes 41. The ball-collecting mechanism 5 can be rotated (slid) around a common axis relative to the ball-catching mechanism 4 by a driving mechanism (not shown).

Figure 4A:
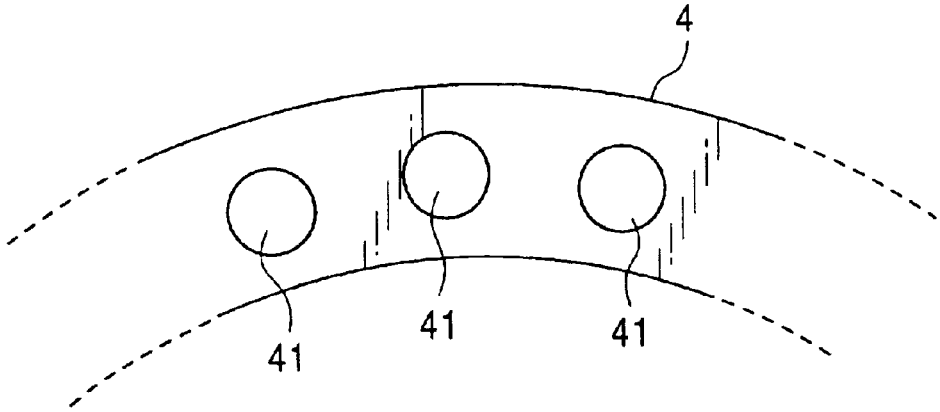
FIG. 4A is a top view of a ball-catching mechanism 4.
Figure 4B:
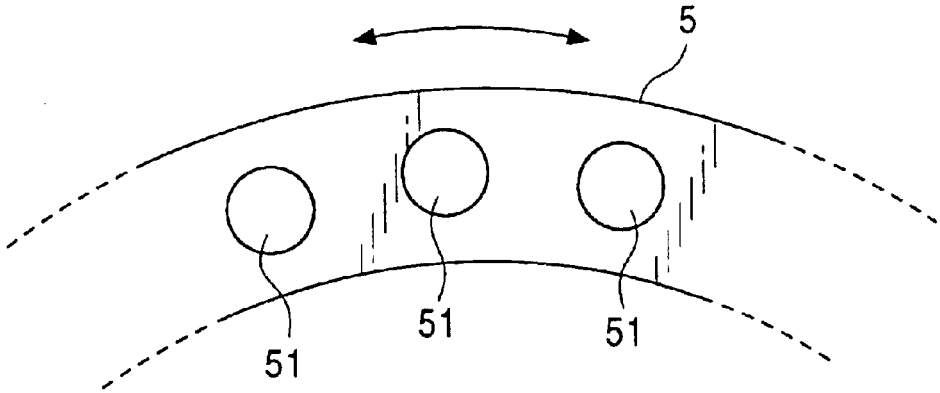
FIG. 4B is a view of the underside of a ball-collecting mechanism 5.
Figure 4C:
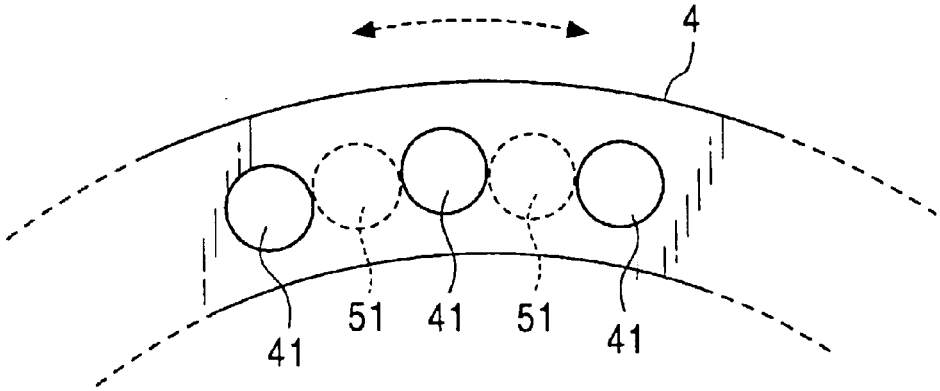
FIG. 4C is a top view of the positional relationship between the ball-catching mechanism 4 and the ball-collecting mechanism 5, as they appear during a draw.

The positional relationship between the ball-catching mechanism 4 and the ball-collecting mechanism 5 is shown in FIGS. 4A, 4B, and 4C. FIG. 4A is a top view of the ball-catching mechanism 4, and FIG. 4B is a view of the underside of the ball-collecting mechanism 5. When a draw begins, ball-catching spaces each having a collecting hole 51 is formed by displacing the ball-collecting mechanism 5 so that all or part of the bottom of each catching hole 41 is covered by the surface of the ball-collecting mechanism 5, as shown in FIG. 4C. Subsequently, until the end of a round of a draw that uses seven balls to select seven different symbols, each ball B is caught in a corresponding ball-catching space Each ball-catching space may also be referred to as a "pocket".

In order that, in the same round of a draw by the bingo game machine, the same symbol is no selected, it is necessary in one round to avoid a situation in which a plurality of balls B are caught in one pocket. This can be achieved by covering each pocket with a lid, etc. In this embodiment, when the ball B is caught in the pocket, as shown in FIG. 3, the ball B is held so that a part thereof protrudes. This can be achieved by adjusting the gap between the ball-catching mechanism 4 and the ball-collecting mechanism 5. This can easily prevent a plurality of balls B from being caught by the same pocket.

Each catching hole 41 in the ball-catching mechanism 4 is uniquely associated with one of the indicator units 7 on the display ring 6 and one of the symbols. Accordingly, when a ball B is caught in a pocket, the corresponding symbol can be specified.

Each player can know by sight by which of the catching holes 41 each ball B has been caught. However, in order to automatically determine which symbol has been selected, each catching hole 41 is provided with a ball-catch-detecting mechanism such as a microswitch, in this embodiment. When a pocket catches a ball B, the ball-catch-detecting mechanism sends a catch-detecting signal to the controller 8.

When a round of a draw ends, the catching holes 41 and the collecting holes 51 are set to coincide with each other by moving the ball-collecting mechanism 5, as shown in FIG. 4C, whereby all the balls B simultaneously fall through the pockets. The fallen balls B are collected by a collecting-and-reuse unit (not shown), and each set of seven collected balls B is returned to the ball-supply mechanism 2 again for reuse.

Each of the above-described mechanisms and components are computer-controlled by the controller 8.

Figure 5:
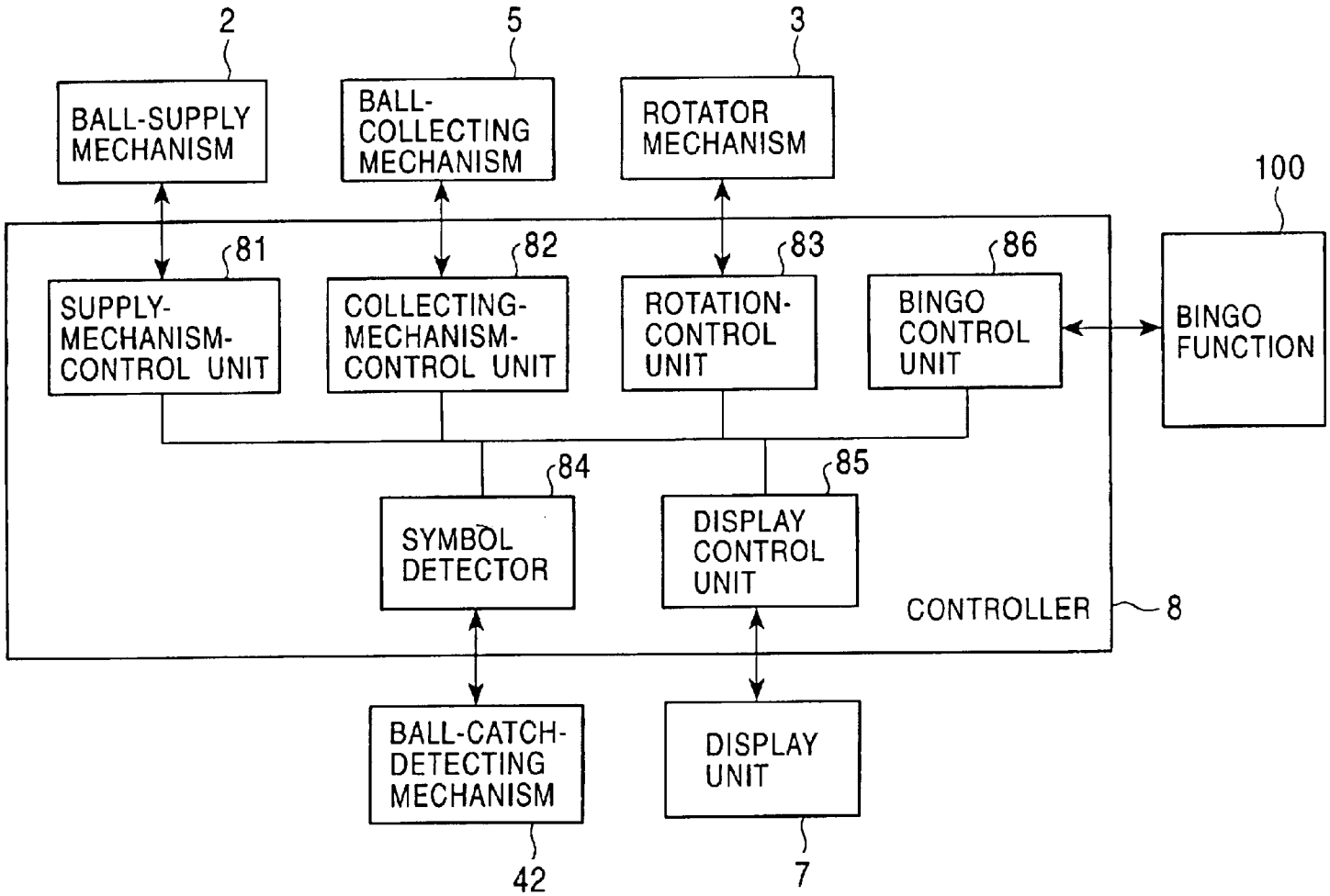
FIG. 5 is a block diagram showing a controller 8 in a number drawing apparatus 10.

FIG. 5 shows the structure of the controller 8. The controller 8 includes a supply-mechanism-control unit 81 for controlling timing for ball supply by the ball-supply mechanism 2, a collecting-mechanism control unit 82 for controlling the ball-collecting mechanism 5, a rotation-control unit 83 for controlling a rotation speed and direction by the rotator mechanism 3, a symbol detector 84 for detecting a symbol, based on a signal output from the ball-catch-detecting mechanism 42 that detects the catching hole 41 in which each ball B is caught, a display control unit 85 for controlling the operation of the corresponding indicator unit 7, and a bingo control unit 86 for association with a bingo function 100.

The rotation-control unit 83 dynamically changes the rotation speed and/or rotational direction by the rotator mechanism 3, thereby changing a value such the rotational speed of the rotating unit 11. This causes each ball B to move randomly.

The bingo function 100 is a mechanism or an electronic component for enabling a bingo game with a number drawing apparatus by a plurality of players, and is a function that has been used. As the bingo function 100, the invention disclosed in, for example, Japanese Unexamined Patent Application Publication No. 8-84804 can be used.

Figure 6:
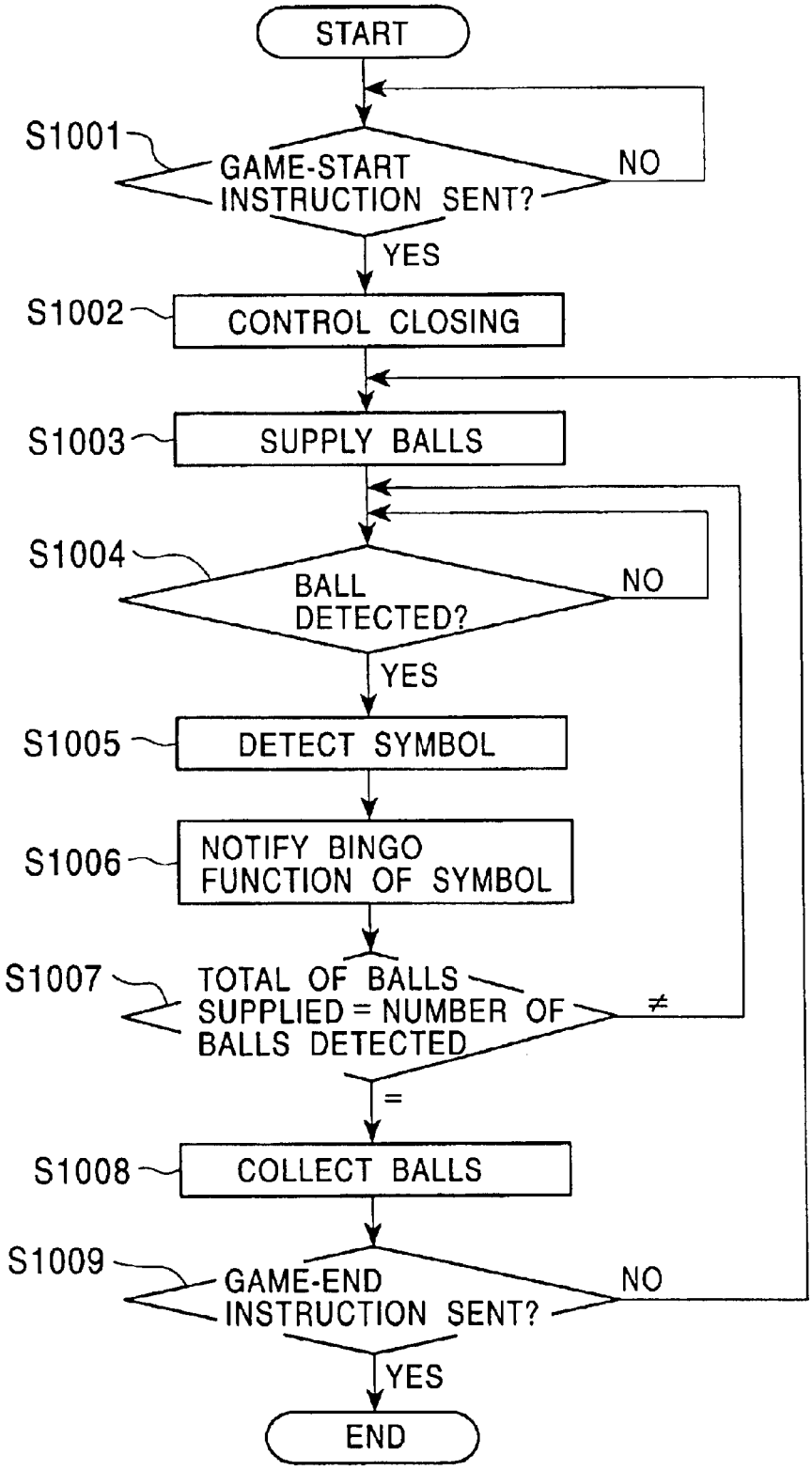
FIG. 6 is a flowchart illustrating a control process performed by the controller 8 shown in FIG. 5.

Next, the operation of the above-described number drawing apparatus 10 in this embodiment is described below with reference to FIG. 6. FIG. 6 shows a control process by the controller 8.

For the draw, the rotator mechanism 3 is driven by the rotation-control unit 83 beforehand so that the rotating unit 11 can rotates in a predetermined direction at a predetermined rotational speed.

An environment for the bingo game is established when a player of the bingo game machine inserts a medal into a medal slot (not shown) of the bingo function 100. Then, the bingo control unit 86 sends a game-start instruction to the collecting-mechanism-control unit 82.

In step S1001, the process determines whether the game-start instruction has been sent.

If the process has determined that the game-start instruction has been sent, the process performs, in step-S1002, pocket-closing control, namely, control for closing the catching holes 41 and the collecting holes 51. By providing the controller 8 with a timer function, pocket-closing control may be performed which is based on the assumption that a game-start instruction is automatically sent when a predetermined time has passed after the insertion of the medal.

In step S1003, ball supply is initiated. In other words, the supply-mechanism-control unit 81 controls the ball-supply mechanism 2, whereby seven balls B are supplied one by one from the supply hole 121 of the supply unit 12 to the surface of the rotating unit 11. In accordance with a friction with the surface of the rotating unit 11, each supplied ball 13 randomly and autonomously rolls from a supplied position in a direction toward the periphery of the rotating unit 11, and moves outwardly. Any of the catching holes 41 catches the ball B.

In step S1004, the process determines whether any of the catching holes 41 has caught the ball B.

If the process has determined in step S1004 that any of the catching holes 41 has caught the ball B, the symbol detector 84 detects a symbol assigned to the catching hole 41, and notifies the bingo function 100 of the notification result via the bingo control unit 86 in step S1006, The bingo function 100 performs bingo-game processing such as a change of the symbol on the indicator unit 7 for each player's seat.

The above-described steps are repeatedly performed for a round until the process determines in step S1007 that the number of detected balls B is equal to a total of supplied balls B. This enables a bingo game in which results of the draw provide different effects to a plurality of players.

When one round of the draw ends, in step S1008, the bingo control unit 86 instructs the collecting-mechanism-control unit 82 to perform pocket-opening control, namely, control for setting the positions of the catching holes 41 and the collecting holes 51 to mutually coincide by sliding the ball-collecting mechanism 5, whereby seven balls B used in the round fall and are collected.

In step S1009, the process determines whether the bingo function 100 has sent a game-end instruction.

If the process has determined in step S1009 that no game-end instruction has been sent, in other words, when the next round of the draw is performed, the steps after step S1003 are repeatedly performed.

If the process has determined in step S1009 that the bingo function 100 has sent the game-end instruction, the control process is terminated.

As described above, in the number drawing apparatus in this embodiment, the friction between the rotating unit 11 and a ball B causes a centrifugal force to act on the ball B so as to move outwardly, whereby the draw is performed. Movement of the ball B and a time until the ball B is supplied from the supply unit 12 to the rotating unit 11 and is caught in the catching hole 41 slightly change in accordance with the rotational speed of the rotating unit 11.

Figure 7:
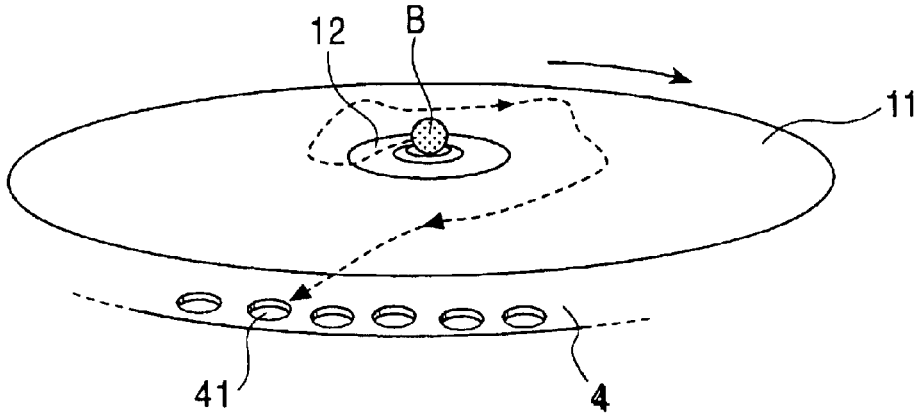
FIG. 7 is an illustration of the movement of a ball B at a relatively slow rotational speed of a rotating unit.

The time until the ball is supplied and caught is prolonged when the rotational speed of the rotating unit 11 is to some extent fast because the ball B rolls on a complicated path. This case is shown in FIG. 7. The reason that the complicated path is formed is that the ball B is returned by a large rebound of the ball B due to a collision with the sidewall and repulsion by the catching holes 41 because large kinetic energy is given to the ball B by a fast rotational speed of the rotating unit 11.

Figure 8:
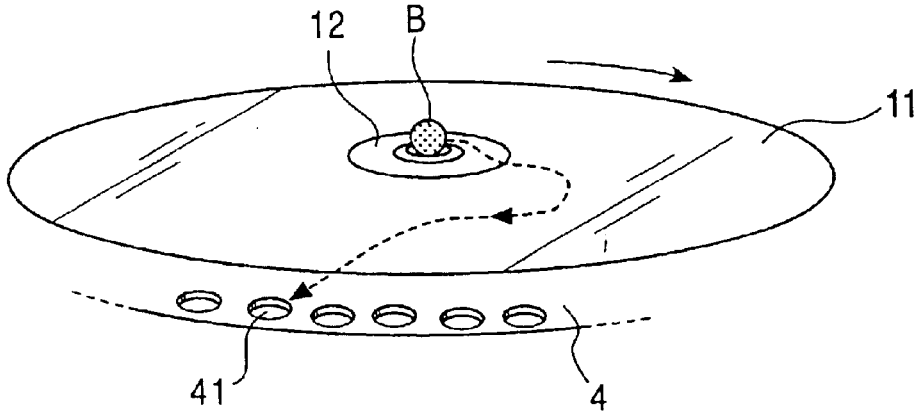
FIG. 8 is an illustration of the movement of a ball B at a relatively fast rotational speed of a rotating unit.
Figure 9:
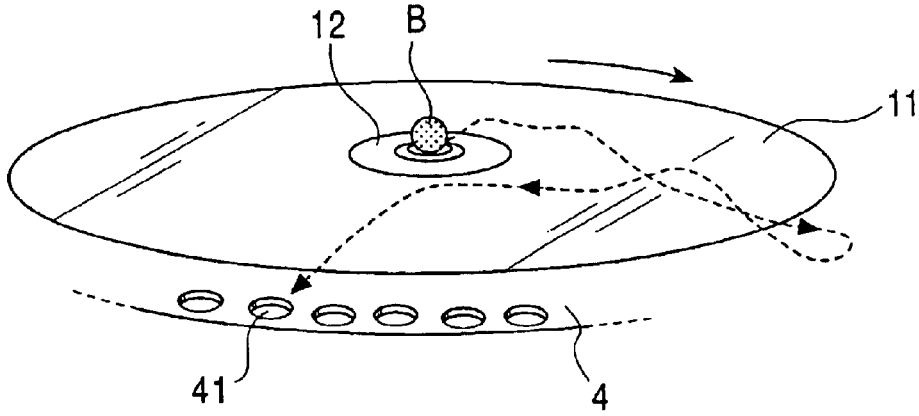
FIG. 9 is an illustration of the movement of a ball B which has rebounded.

Conversely, when the rotational speed of the rotating unit 11 is to some extent slow, a time until the ball B is caught in the catching hole 41 shortens as shown in FIG. 8. This is because a rebound of the ball B due to a collision with the sidewall is small, a possibility of a repulsion of the ball B by the catching holes 41 is low, and the ball B is caught before greatly moving on the rotating unit 11.

A behavior of the ball B greatly differs depending on the weight of the ball B, a friction coefficient of the rotating unit 11, etc. For example, a metal-plated ball and a resin ball differ in behavior even when both balls have the same weight if other conditions are equally set.

Therefore, in an actual operation, the rotational speed of the rotating unit 11 must be changed in view of these characteristics.

When the ball B is not directly caught in one of the catching holes 41, the ball B rebounds (with an acceleration) from the inclined sidewall 61 of the display ring 6 to the rotating unit 11, rolls randomly again, and falls in one of the catching holes 41. Thus, the draw operation cannot be interrupted. Accordingly, management of the time required for one round of the draw is extremely facilitated, which solves the problem of time management for retry of the draw in the foregoing second well-known art.

The scope of the present invention is not limited to the above-described embodiment since the present invention is characterized in that a rolling body such as a ball is controlled to randomly roll on the rotating unit 11 so as to move outwardly, and information specified by the outward movement of the rolling body is used as the draw result.

By way of example, in the above-described embodiment, the supply unit 12 is provided in the central portion of the rotating unit 11. However, the supply unit 12 may be provided at a position excluding the central portion. Also, for supplying the ball B, the ball B may be dropped from a position above he rotating unit 11 without providing the supply unit 12.

Although the above-described embodiment has described the case where a plurality of balls B are supplied one by one to the rotating unit 11 and movement of the ball B is enjoyed by the player, a form in which a plurality of balls B are simultaneously supplied to the rotating unit 11 may be employed.

The above-described embodiment has been described on the assumption that a plurality of balls B have the same quality and the same shape. However, various types of balls may be used for the draw. This allows the balls to differently characteristically move, which can enhance the entertainment in the draw.

Although balls are used as rolling bodies in the above-described embodiment, polygons such as regular dodecahedrons and regular icosahedrons, and things which have an external surface including a plane and which can roll can be used.

Since the draw is possible if each ball B moving outwardly from the rotating unit 11 can be detected, the ball-catching mechanism 4, etc., can be omitted. For example, as in the first well-known art, by assigning unique identifying symbols to rolling bodies, and identifying the identifying symbols in the order the rolling bodies move outwardly from the rotating unit 11, a simplified structure can realize a number drawing apparatus. Also, rolling bodies to which different symbols are assigned in accordance with stop positions or the postures of the rolling bodies, such as dice, are supplied to the rotating unit 11, and the symbols obtained when they move outwardly from the rotating unit 11 may be used as the result of the draw.

What is claimed is:

1. A number drawing apparatus, comprising:

a rotating unit having a surface which rolls rolling bodies supplied thereon, wherein the rotating unit consists of a transparent disk member having a vertical axis, said rotating unit rotates in a plane perpendicular to the vertical axis of the disk member;

rolling-body-supply means for supplying the rolling bodies from the central portion of said rotating unit to the surface; and driving means for rotating said rotating unit in a fixed plane so that the supplied rolling bodies move outwardly from said rotating unit;

wherein the driving means dynamically changes the rotational speed of the disk member for changing the rotational speed and/or rotational direction of the rolling bodies;

wherein information specified by the outward movement of each of the supplied rolling bodies is used as the result of a draw of numbers.

2. A number drawing apparatus according to claim 1, wherein unique information specified by the moving rolling bodies when the bodies have stopped is used as the result of the draw.

3. A number drawing apparatus according to claim 2, wherein a plurality of regions to which unique symbols are assigned are provided along the periphery of said rotating unit, and the result of the draw is determined by the symbols assigned to the regions in which the rolling bodies stops.

4. A number drawing apparatus according to claim 1, wherein N different symbols, determined by the outward movement of N rolling bodies, are specified as the results of the draw, where N represents a natural number not less than 2.

5. A number drawing apparatus according to claim 1, wherein the rolling bodies are spheres.

6. A number drawing apparatus according to claim 1, wherein the driving means dynamically changes the rotational speed and/or rotational direction of the rolling bodies.

7. A game machine according to claim 1, wherein a photograph or decorative backing attached to the back of the transparent disk member.

8. A number drawing apparatus according to claim 1, wherein a plurality of regions to which unique symbols are assigned are provided along the periphery of said rotating unit; and wherein said number drawing apparatus is a bingo game machine, and further comprising indicator units corresponding to different symbols for emitting light directed at a player who has only to one more number to reach bingo, each indicator unit informs each player of this fact and symbols indicating bingo.

9. A number drawing apparatus, comprising:

a rotating unit having a surface which rolls rolling bodies supplied thereon, wherein the rotating unit consists of a transparent disk member having a vertical axis, and rotates in a plane perpendicular to the vertical axis of the disk member;

rolling-body-supply means for supplying the rolling bodies from the central portion of said rotating unit to the surface;

driving means for rotating said rotating unit in a fixed plane so that each of the supplied rolling bodies randomly travel outwardly from a supplied position in a direction toward the periphery of said rotating unit; and a plurality of catching units provided along the periphery of said rotating unit, the catching units each having a unique symbol assigned thereto;

wherein the driving means dynamically changes the rotational speed of the disk member for changing the rotational speed and/or rotational direction of the rolling bodies;

wherein the result of a draw of numbers is specified by the symbol assigned to the catching unit in which the moving rolling body is caught.

10. A number drawing apparatus according to claim 9, wherein the plurality of catching units each include a detecting means for outputting a predetermined signal when the rolling body is caught, and the output signal specifies the symbol assigned to the catching unit in which the rolling body is caught.

11. A number drawing apparatus according to claim 9, wherein when the catching units catch the rolling bodies, the catching units hold the rolling bodies so that the rolling bodies partly protrude, and allow the rolling bodies to fall with predetermined timing.

12. A number drawing apparatus according to claim 9, wherein until N different symbols are determined in sets of N rolling bodies where N represents a natural number not less than 2, the catching units hold the N rolling bodies, and allow all the N rolling bodies to simultaneously fall with predetermined timing.

13. A number drawing apparatus according to claim 9, wherein the rolling-body-supply means includes a supply hole for supplying the rolling bodies, and a guidance mechanism for accelerating the rolling bodies and for guiding the accelerated rolling bodies to the surface.

14. A number drawing apparatus according to claim 13, wherein the distance between the supply hole and the surface is equal in all directions.

15. A number drawing apparatus according to claim 9, further comprising a return wall for returning each of the rolling bodies which has not been caught by any one of the catching units.

16. A number drawing apparatus according to claim 15, wherein the return wall accelerates the rolling body and returns the accelerated rolling body.

17. A number drawing apparatus according to claim 9, wherein the rolling bodies are spheres.

18. A number drawing apparatus according to claim 9, wherein the driving means dynamically changes the rotational speed and/or rotational direction of the rolling bodies.

19. A game machine according to claim 9, wherein a photograph or decorative backing is provided on the back of the rotating unit.

20. A number drawing apparatus according to claim 9, wherein said number drawing apparatus is a bingo game machine, and further comprising indicator units corresponding to different symbols for emitting light directed at a player who has only to one more number to reach bingo, each indicator unit informs each player of this fact and symbols indicating bingo.

21. A number drawing apparatus, comprising:

a rotating unit having a surface which rolls rolling bodies in which each attitude of the rolling bodies or each position at which the rolling bodies stop specifies a unique symbol, wherein the rotating unit consists of a transparent disk member having a vertical axis, and rotates in a plane perpendicular to the vertical axis of the disk member;

rolling-body-supply means for supplying the rolling bodies from the central portion of the rotating unit to the surface; and driving means for rotating the rotating unit so that each of the supplied rolling bodies randomly travel outwardly for a supplied position in a direction toward the periphery of the rotating unit;

wherein the driving means dynamically changes the rotational speed of the disk member for changing the rotational speed and/or rotational direction of the rolling bodies;

wherein symbols specified by the moving rolling bodies when the bodies have stopped are used as the results of a draw of numbers.

22. A number drawing apparatus according to claim 21, wherein the driving means dynamically changes the rotational speed and/or rotational direction of the rolling bodies.

23. A number drawing apparatus according to claim 21, wherein said number drawing apparatus is a bingo game machine, and further comprising indicator units corresponding to different symbols for emitting light directed at a player who has only to one more number to reach bingo, each indicator unit informs each player of this fact and symbols indicating bingo.

24. A game machine including a number drawing apparatus and providing a game player with a game prize in accordance with the result of a draw of numbers by the number drawing apparatus, the number drawing apparatus comprising:

a rotating unit having a surface which rolls rolling bodies supplied thereon, wherein the rotating unit consists of a transparent disk member having a vertical axis, and rotates in a plane perpendicular to the vertical axis of the disk member;

rolling-body-supply means for supplying the rolling bodies from the central portion of said rotating unit to the surface; and driving means for rotating the rotating unit in a fixed plane so that the supplied rolling bodies move outwardly from the rotating unit;

wherein the driving means dynamically changes the rotational speed of the disk member for changing the rotational speed and/or rotational direction of the rolling bodies;

wherein information specified by the outward movement of each of the supplied rolling bodies is used as the result of a draw of numbers.

25. A game machine according to claim 24, wherein the game machine is a bingo game machine in which the result of the draw provides different effects to a plurality of game players.

26. A game machine according to claim 24, wherein a plurality of regions to which unique symbols are assigned are provided along the periphery of said rotating unit; and wherein said number drawing apparatus is a bingo game machine, and further comprising indicator units corresponding to different symbols for emitting light directed at a player who has only to one more number to reach bingo, each indicator unit informs each player of this fact and symbols indicating bingo.

27. A game machine including a number drawing apparatus and providing a game player with a game prize in accordance with the result of a draw of numbers by the number drawing apparatus, the number drawing apparatus comprising: a rotating unit having a surface which rolls rolling bodies supplied thereon having a vertical axis, wherein the rotating unit consists of a transparent disk member, and rotates in a plane perpendicular to the vertical axis of the disk member;

rolling-body-supply means for supplying the rolling bodies from the central portion of the rotating unit to the surface;

driving means for rotating the rotating unit in a fixed plane so that each of the supplied rolling bodies randomly travel outwardly from a supplied position in a direction toward the periphery of the rotating unit; and a plurality of catching units provided along the periphery of the rotating unit, the catching units each having a unique symbol assigned thereto;

wherein the driving means dynamically changes the rotational speed of the disk member for changing the rotational speed and/or rotational direction of the rolling bodies;

wherein the result of a draw of numbers is specified by the symbol assigned to the catching unit in which the moving rolling body is caught.

28. A game machine according to claim 27, wherein the game machine is a bingo game machine in which the result of the draw provides different effects to a plurality of game players.

29. A game machine according to claim 27, wherein said number drawing apparatus is a bingo game machine, and further comprising indicator units corresponding to different symbols for emitting light directed at a player who has only to one more number to reach bingo, each indicator unit informs each player of this fact and symbols indicating bingo.

30. A number drawing apparatus according to claim 27, further comprising a return wall for returning each of the rolling bodies which has not been caught by any one of the catching units.

31. A number drawing apparatus according to claim 30, wherein the return wall accelerates the rolling body and returns the accelerated rolling body.

32. A game machine including a number drawing apparatus and providing a game player with a game prize in accordance with the result of a draw of numbers by the number drawing apparatus, the number drawing apparatus comprising:

a rotating unit having a surface which rolls rolling bodies in which each attitude of the rolling bodies or each position at which the rolling bodies stop specifies a unique symbol, wherein the rotating unit consists of a transparent disk member having a vertical axis, and rotates in a plane perpendicular to the vertical axis of the disk member;

rolling-body-supply means for supplying the rolling bodies from the central portion of the rotating unit to the surface; and driving means for rotating the rotating unit so that each of the supplied rolling bodies randomly travel outwardly from a supplied position in a direction toward the periphery of the rotating unit;

wherein the driving means dynamically changes the rotational speed of the disk member for changing the rotational speed and/or rotational direction of the rolling bodies;

wherein symbols specified by the moving rolling bodies when the bodies have stopped are used as the results of a draw of numbers.

33. A game machine according to claim 32, wherein the game machine is a bingo game machine in which the result of the draw provides different effects to a plurality of game players.

34. A game machine according to claim 32, wherein said number drawing apparatus is a bingo game machine, and further comprising indicator units corresponding to different symbols for emitting light directed at a player who has only to one more number to reach bingo, each indicator unit informs each player of this fact and symbols indicating bingo.

35. A number drawing apparatus, comprising:

a rotating unit having a surface which rolls rolling bodies supplied thereon, said rotating unit rotates in a plane perpendicular to the vertical axis of the disk member, wherein said surface is flat;

rolling-body-supply means for supplying the rolling bodies from the central portion of said rotating unit to the surface; and driving means for rotating said rotating unit in a fixed plane so that the supplied rolling bodies move outwardly from said rotating unit;

wherein the driving means dynamically changes the rotational speed of the disk member for changing the rotational speed and/or rotational direction of the rolling bodies;

wherein information specified by the outward movement of each of the supplied rolling bodies is used as the result of a draw of numbers.

36. A number drawing apparatus, comprising:

a rotating unit having a surface which rolls rolling bodies supplied thereon, and rotates in a plane perpendicular to the vertical axis of the disk member, wherein said surface is flat;

rolling-body-supply means for supplying the rolling bodies from the central portion of said rotating unit to the surface;

driving means for rotating said rotating unit in a fixed plane so that each of the supplied rolling bodies randomly travel outwardly from a supplied position in a direction toward the periphery of said rotating unit; and a plurality of catching units provided along the periphery of said rotating unit, the catching units each having a unique symbol assigned thereto;

wherein the driving means dynamically changes the rotational speed of the disk member for changing the rotational speed and/or rotational direction of the rolling bodies;

wherein the result of a draw of numbers is specified by the symbol assigned to the catching unit in which the moving rolling body is caught.

37. A number drawing apparatus according to claim 36, further comprising a return wall for returning each of the rolling bodies which has not been caught by any one of the catching units.

38. A number drawing apparatus according to claim 37, wherein the return wall accelerates the rolling body and returns the accelerated rolling body.

39. A number drawing apparatus, comprising:

a rotating unit having a surface which rolls rolling bodies in which each attitude of the rolling bodies or each position at which the rolling bodies stop specifies a unique symbol, and rotates in a plane perpendicular to the vertical axis of the disk member, wherein said surface is flat;

rolling-body-supply means for supplying the rolling bodies from the central portion of the rotating unit to the surface; and driving means for rotating the rotating unit so that each of the supplied rolling bodies randomly travel outwardly from a supplied position in a direction toward the periphery of the rotating unit;

wherein the driving means dynamically changes the rotational speed of the disk member for changing the rotational speed and/or rotational direction of the rolling bodies;

wherein symbols specified by the moving rolling bodies when the bodies have stopped are used as the results of a draw of numbers.

40. A game machine including a number drawing apparatus and providing a game player with a game prize in accordance with the result of a draw of numbers by the number drawing apparatus, the number drawing apparatus comprising:

a rotating unit having a surface which rolls rolling bodies supplied thereon having a vertical axis, and rotates in a plane perpendicular to the vertical axis of the disk member, wherein said surface is flat;

rolling-body-supply means for supplying the rolling bodies from the central portion of the rotating unit to the surface;

driving means for rotating the rotating unit in a fixed plane so that each of the supplied rolling bodies randomly travel outwardly from a supplied position in a direction toward the periphery of the rotating unit; and a plurality of catching units provided along the periphery of the rotating unit, the catching units each having a unique symbol assigned thereto;

wherein the driving means dynamically changes the rotational speed of the disk member for changing the rotational speed and/or rotational direction of the rolling bodies;

wherein the result of a draw of numbers is specified by the symbol assigned to the catching unit in which the moving rolling body is caught.

41. A number drawing apparatus according to claim 40, further comprising a return wall for returning each of the rolling bodies which has not been caught by any one of the catching units.

42. A number drawing apparatus according to claim 41, wherein the return wall accelerates the rolling body and returns the accelerated rolling body.

43. A game machine including a number drawing apparatus and providing a game player with a game prize in accordance with the result of a draw of numbers by the number drawing apparatus, the number drawing apparatus comprising:

a rotating unit having a surface which rolls rolling bodies supplied thereon, and rotates in a plane perpendicular to the vertical axis of the disk member, wherein said surface is flat;

rolling-body-supply means for supplying the rolling bodies from the central portion of said rotating unit to the surface; and driving means for rotating the rotating unit in a fixed plane so that the supplied rolling bodies move outwardly from the rotating unit;

wherein the driving means dynamically changes the rotational speed of the disk member for changing the rotational speed and/or rotational direction of the rolling bodies;

wherein information specified by the outward movement of each of the supplied rolling bodies is used as the result of a draw of numbers.

44. A game machine including a number drawing apparatus and providing a game player with a game prize in accordance with the result of a draw of numbers by the number drawing apparatus, the number drawing apparatus comprising:

a rotating unit having a surface which rolls rolling bodies in which each attitude of the rolling bodies or each position at which the rolling bodies stop specifies a unique symbol, and rotates in a plane perpendicular to the vertical axis of the disk member, wherein said surface is flat;

rolling-body-supply means for supplying the rolling bodies from the central portion of the rotating unit to the surface; and driving means for rotating the rotating unit so that each of the supplied rolling bodies randomly travel outwardly from a supplied position in a direction toward the periphery of the rotating unit;

wherein the driving means dynamically changes the rotational speed of the disk member for changing the rotational speed and/or rotational direction of the rolling bodies;

wherein symbols specified by the moving rolling bodies when the bodies have stopped are used as the results of a draw of numbers.

* * * * *